US008771033B2

(12) United States Patent
Goszewski et al.

(10) Patent No.: US 8,771,033 B2
(45) Date of Patent: Jul. 8, 2014

(54) MOBILE FOR INFANT SUPPORT STRUCTURE

(75) Inventors: Robert M. Goszewski, Depew, NY (US); Patrick J. Murphy, East Aurora, NY (US); David E. Moomaw, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 805 days.

(21) Appl. No.: 12/797,921

(22) Filed: Jun. 10, 2010

(65) Prior Publication Data

US 2010/0323581 A1 Dec. 23, 2010

Related U.S. Application Data

(60) Provisional application No. 61/187,783, filed on Jun. 17, 2009.

(51) Int. Cl.
*A63H 33/00* (2006.01)

(52) U.S. Cl.
USPC ..... 446/227

(58) Field of Classification Search
USPC ..... 446/238, 227–229, 484
See application file for complete search history.

(56) References Cited

U.S. PATENT DOCUMENTS

| | | | | |
|---|---|---|---|---|
| 2,405,313 | A | | 8/1946 | Martin |
| 2,470,407 | A | | 5/1949 | Murphy |
| 2,994,156 | A | | 8/1961 | Steiner et al. |
| 3,375,600 | A | | 4/1968 | Poulos |
| 3,564,759 | A | | 2/1971 | Buttermore |
| 3,919,795 | A | | 11/1975 | Van Horne Jinivisian et al. |
| 3,983,647 | A | | 10/1976 | Stubbmann |
| 4,207,696 | A | * | 6/1980 | Hyman et al. ..... 40/473 |
| 4,363,181 | A | | 12/1982 | Hyman et al. |
| 4,430,818 | A | * | 2/1984 | Marcus ..... 40/429 |
| 4,438,727 | A | | 3/1984 | Thompson |
| 4,600,399 | A | * | 7/1986 | Abe ..... 446/242 |
| 4,640,034 | A | | 2/1987 | Zisholtz |
| 4,664,640 | A | * | 5/1987 | Shindo et al. ..... 446/227 |
| 4,880,197 | A | * | 11/1989 | Wsyzynski ..... 248/324 |
| 4,984,380 | A | | 1/1991 | Anderson |
| 5,112,267 | A | * | 5/1992 | Liu et al. ..... 446/470 |
| 5,167,559 | A | | 12/1992 | Power-Fardy |
| 5,320,573 | A | * | 6/1994 | Matsuyama ..... 446/358 |
| 5,462,471 | A | | 10/1995 | Power-Fardy |
| 5,672,088 | A | | 9/1997 | Chininis |
| 5,732,493 | A | * | 3/1998 | Luedtke et al. ..... 40/485 |

(Continued)

OTHER PUBLICATIONS

International Preliminary Report on Patentability for PCT/US2010/038272, dated Dec. 20, 2011, 6 pages.

(Continued)

*Primary Examiner* — Gene Kim
*Assistant Examiner* — Alyssa Hylinski
(74) *Attorney, Agent, or Firm* — Edell, Shapiro & Finnan, LLC

(57) ABSTRACT

A mobile mountable to an infant support structure includes a housing having a drive mechanism, a support arm extending from the housing, and an assembly supported from the support arm. The support arm is connected to the drive mechanism and movable relative to the housing in first and second opposite directions. The assembly includes a hub, a motion portion, and a hanging portion. The motion portion has a resilient component coupled to the hanging portion, which drives the hanging portion in a third direction when the support arm moves in the first direction.

14 Claims, 12 Drawing Sheets

(56) References Cited

U.S. PATENT DOCUMENTS

| | | | | |
|---|---|---|---|---|
| 5,803,786 | A | 9/1998 | McCormick | |
| 5,951,360 | A | 9/1999 | Fearon et al. | |
| 6,230,440 | B1 * | 5/2001 | Deutsch | 47/67 |
| 6,413,141 | B1 | 7/2002 | Putney | |
| 6,464,555 | B1 | 10/2002 | Paduano | |
| 6,705,950 | B2 | 3/2004 | Wood et al. | |
| 7,172,486 | B2 | 2/2007 | Drosendahl et al. | |
| 7,247,078 | B2 | 7/2007 | Bapst et al. | |
| 7,264,534 | B2 * | 9/2007 | Stubenfoll | 446/227 |
| 7,275,996 | B2 | 10/2007 | Dillner et al. | |
| 7,344,428 | B2 * | 3/2008 | Ransil et al. | 446/227 |
| 7,381,138 | B2 | 6/2008 | Dillner et al. | |
| 2002/0094748 | A1 | 7/2002 | Baik | |
| 2003/0064818 | A1 | 4/2003 | Drosendahl et al. | |
| 2005/0197040 | A1 | 9/2005 | Babbidge et al. | |
| 2006/0199468 | A1 * | 9/2006 | Mastrosimone-Gese | 446/227 |
| 2006/0264148 | A1 * | 11/2006 | Sejnowski et al. | 446/227 |
| 2007/0249260 | A1 * | 10/2007 | Bapst et al. | 446/227 |
| 2008/0081538 | A1 | 4/2008 | Ostrow et al. | |
| 2008/0090488 | A1 | 4/2008 | Lightner | |
| 2008/0176480 | A1 | 7/2008 | Gelfond et al. | |

OTHER PUBLICATIONS

International Search Report for PCT/US2010/038272, dated Feb. 7, 2011, 3 pages.

* cited by examiner

MOBILE FOR INFANT SUPPORT STRUCTURE

CROSS-REFERENCE TO RELATED APPLICATION

This application claims priority to U.S. Provisional Patent Application Ser. No. 61/187,783, entitled "Mobile for Infant Support Structure," filed Jun. 17, 2009, the disclosure of which is incorporated herein by reference in its entirety.

FIELD OF THE INVENTION

The present invention relates to toy entertainment devices, and in particular, to mobile toy devices that mount to a crib or other infant support structure.

BACKGROUND OF THE INVENTION

Infants develop by interacting with their surrounding environment. Sensory stimuli are an infant's first sources of learning. For example, seeing moving elements fosters development of visual tracking skills, and listening to music and sounds stimulates auditory skills.

Consequently, toys are often developed to create an interactive, sensory stimulating experience for an infant. For example, mobiles aid the development of an infant by improving vision and eye-tracking skills. When an infant focuses on an object suspended from a mobile, visual tracking skills are stimulated. In addition, it is believed that music and sounds generated by the toys enhance listening skills and inspire creative thinking.

Some mobiles include rotatable elements to enhance sensory stimulation. Movement of the rotatable elements may be activated by a wind-up mechanism or powered by a motor. However, such mobiles only provide for movement about a single stationary axis. It would be desirable to provide a mobile that increases the developmental potential of an infant by providing an additional level of visual tracking stimulation.

SUMMARY OF THE INVENTION

The present invention relates to a mobile mountable to an infant support structure, such as a crib. In one embodiment, the mobile has a housing supported by the infant support structure, and includes a drive mechanism. A support arm extends from the housing. The support arm is connected to the drive mechanism and movable relative to the housing in a first direction and in a second direction, the second direction being opposite to the first direction. An assembly is supported from the support arm, and includes a hub, a motion portion, and a hanging portion. The motion portion has at least one resilient component coupled to the hanging portion. The resilient component drives the hanging portion in a third direction when the support arm moves in the first direction, the third direction being different than the first direction and the second direction.

In one embodiment, the at least one resilient component is configured not to drive the hanging portion when the support arm moves in the second direction.

In one embodiment, the motion portion includes a first resilient component and a second resilient component. Each of the resilient components is coupled to the hanging portion. The first resilient component drives the hanging portion in the third direction when the support arm moves in the first direction, and the second resilient component drives the hanging portion in the third direction when the support arm moves in the second direction.

In one embodiment, the hub includes an engagement surface, and the resilient component includes a spring having an outwardly extending end engageable with the engagement surface.

In one embodiment, the hub includes a first engagement surface and a second engagement surface, the first engagement surface being spaced apart from the second engagement surface. The resilient component includes a spring having an outwardly extending end extending between the first and second engagement surfaces. The outwardly extending spring end engages the first engagement surface when the support arm moves in the first direction, and the spring end moves away from the first engagement surface when the support arm moves in the second direction.

In one embodiment, the resilient component includes a first spring and a second spring. The first spring has an end portion extending away from the hanging portion and the second spring has an end portion extending away from the hanging portion. The second spring end portion extends in a direction substantially opposite to the direction in which the first spring end portion extends.

In one embodiment, movement of the support arm in the first direction causes one of the first and second springs to change its configuration. The change in configuration of the one of the first and second springs causes the hanging portion to move in the third direction.

In one embodiment, movement of the support arm in the first direction causes the first spring to change its configuration, and movement of the support arm in the second direction causes the second spring to change its configuration. The change in configuration of each of the first and second springs causes rotation of the hanging portion in the third direction.

In another embodiment, a mobile includes a housing having a drive mechanism, a support arm extending from the housing and connected to the drive mechanism, and an assembly supported from the support arm. The support arm is movable relative to the housing in a first direction and in a second direction. The assembly includes a hub, a motion portion, and a hanging portion. The motion portion has a resilient mechanism coupled to the hanging portion. The resilient mechanism moves the hanging portion in a third direction when the support arm moves in the first direction, and the resilient member moves the hanging portion in the third direction when the support arm moves in the second direction. The third direction is different than the first direction and the second direction.

In one embodiment, the resilient mechanism includes a first spring member and a second spring member. The first spring member has an end extending from the hanging portion, and the second spring member has an end extending from the hanging portion in a direction substantially opposite to the direction in which the first spring member end extends.

In one embodiment, the hub includes a first pair of engagement surfaces and a second pair of engagement surfaces. The end of the first spring member is engageable with the first pair of engagement surfaces, and the end of the second spring member is engageable with the second pair of engagement surfaces.

The present invention also relates to an entertainment device including a base, a support movably coupled to the base, and an entertainment mechanism coupled to the support and movable relative thereto. The entertainment mechanism includes an actuator having a first configuration. The actuator changes its configuration to a second configuration when the actuator engages the support as the support moves relative to the base. The change in configuration of the actuator causes movement of the entertainment mechanism relative to the support.

In one embodiment, the support includes a first engagement surface and a second engagement surface. The engagement surfaces define an area therebetween, and the actuator extends into the area between the engagement surfaces. The actuator changes its configuration when the actuator engages one of the engagement surfaces.

In one embodiment, the entertainment mechanism includes a body portion, and the actuator is mounted on the body portion. The actuator in its first configuration is moveable relative to the body portion, and the actuator in its second configuration is movable with the body portion.

In one embodiment, the body portion has an outer surface, and the actuator is placed around part of the body portion outer surface. The actuator in its first configuration is spaced apart from the outer surface of the body portion, and the actuator in its second configuration grips the outer surface of the body portion.

In one embodiment, the actuator is a first actuator and the entertainment mechanism includes a second actuator. The second actuator changes its configuration when the second actuator engages the support. The change in configuration of the first actuator causes the entertainment mechanism to rotate relative to the support. The change in configuration of the second actuator causes the entertainment mechanism to rotate relative to the support.

In one embodiment, each of the first and second actuators is a resilient member.

In one embodiment, the base includes a drive mechanism. The support is coupled to the drive mechanism and movable by the drive mechanism relative to the base.

BRIEF DESCRIPTION OF THE DRAWINGS

Like reference numerals have been used to identify like elements throughout this disclosure.

DETAILED DESCRIPTION OF THE INVENTION

The terms "support" or "support structure" are used to refer to any frame or support that is configured to provide support for an object. The term "infant support structure" can be used to refer to any frame or support that can be used to support an infant in a stationary manner or in a moving manner. Some exemplary infant support structures are cribs, bassinets, playyards, jumping devices, bouncers, infant seats, etc. The terms "child" and "infant" may be used interchangeably herein.

Further, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Figure 1:
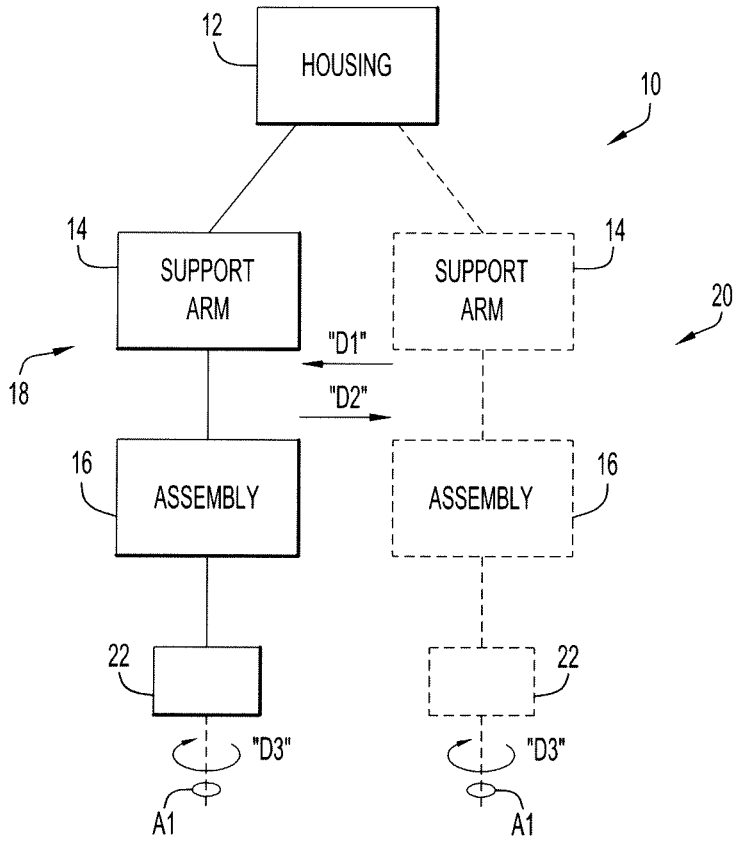
FIG. 1 illustrates a schematic block diagram of an embodiment of a mobile according to an embodiment of the present invention.

Referring to FIG. 1, a schematic block diagram of an embodiment of a mobile 10 according to the present invention is illustrated. In this embodiment, the mobile 10 includes a housing 12 mountable to an infant support structure, such as a frame of a crib, a support arm 14 extending from the housing 12, and an entertainment assembly 16 supported from the support arm 14.

The support arm 14 is moveable in a first direction shown by arrow D1, and moveable in a second opposite direction shown by arrow D2. The support arm 14 is moveable in the first direction D1 to a first position 18, and moveable in the second direction D2 to a second position 20 (shown in phantom). Thus, the support arm 14 is pivotally moveable between the first and second positions 18, 20.

As the support arm 14 moves in the first direction D1 to the first position 18, the entertainment assembly 16 likewise moves in the first direction D1 given it is supported from the support arm 14. As the support arm 14 moves in the second direction D2 to the second position 20, the entertainment assembly 16 moves in the second direction D2.

The entertainment assembly 16 includes a hanging portion 22 that moves in a third direction D3 when the support arm 14 moves in the first direction D1. Preferably, the hanging portion 22 rotates about an axis A1 in the third direction D3 when the support arm 14 moves in the first direction D1 to the first position 18. Alternatively or in addition, the hanging portion 22 may rotate about axis A1 in the third direction D3 when the support arm 14 moves in the second direction D2 to the second position 20. Thus, the hanging portion 22 rotates about axis A1 in the third direction D3 as the assembly 16 pivots back and forth between the first and second positions 18, 20.

Figure 2:
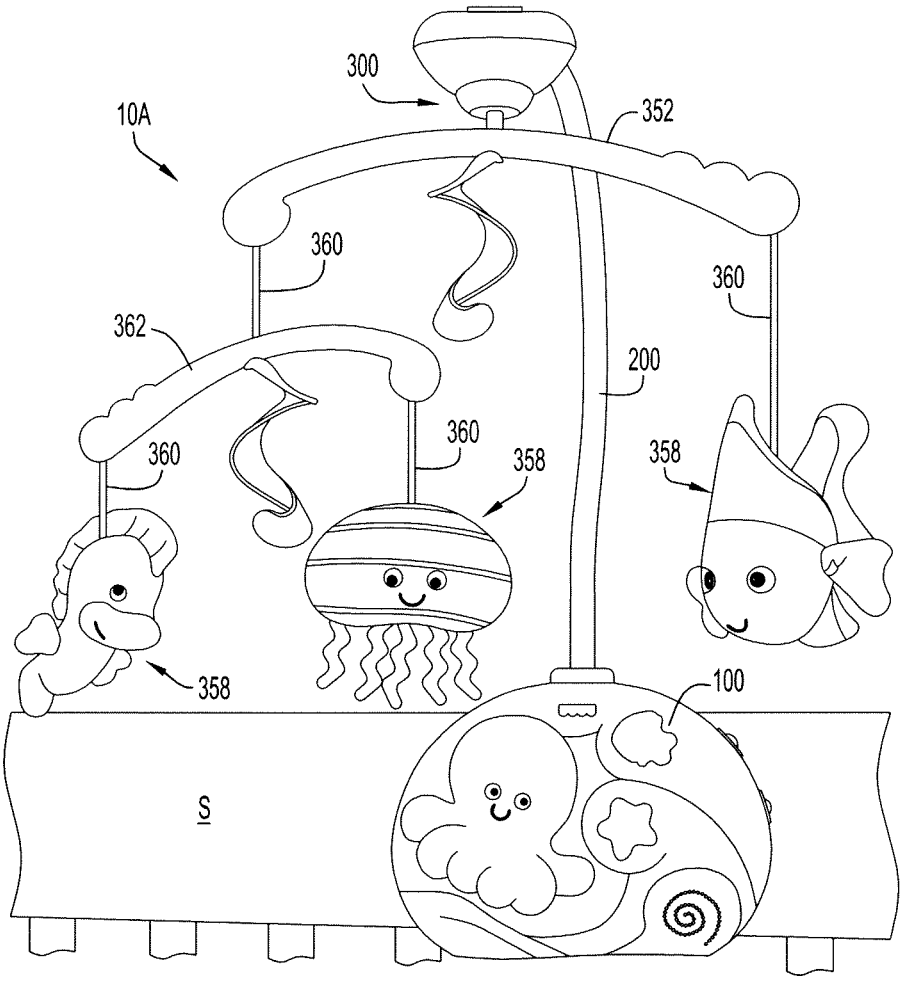
FIG. 2 illustrates a perspective view of a mobile mounted to a support structure and including a housing, a support arm, and an entertainment assembly according to an embodiment of the invention.

Referring to FIG. 2, an embodiment of a mobile 10A according to the present invention is illustrated. The mobile 10A includes a housing 100 mountable to an infant support structure S, a support arm 200 extending from the housing 100, and an assembly 300 supported from the support arm 200. As described in greater detail below, the assembly 300 includes support bars 352 and 362, several connectors 360, and hanging elements 358.

Figure 3:
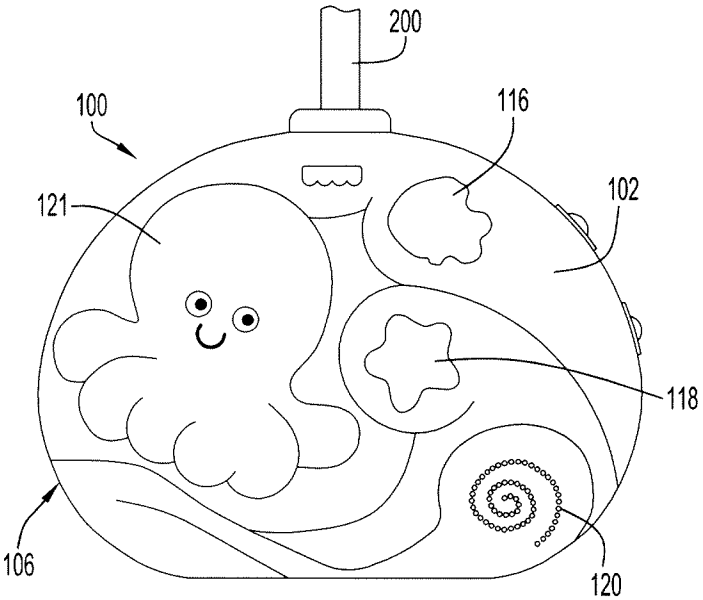
FIG. 3 illustrates a front view of the housing and a portion of the support arm of the mobile illustrated in FIG. 2.
Figure 4:
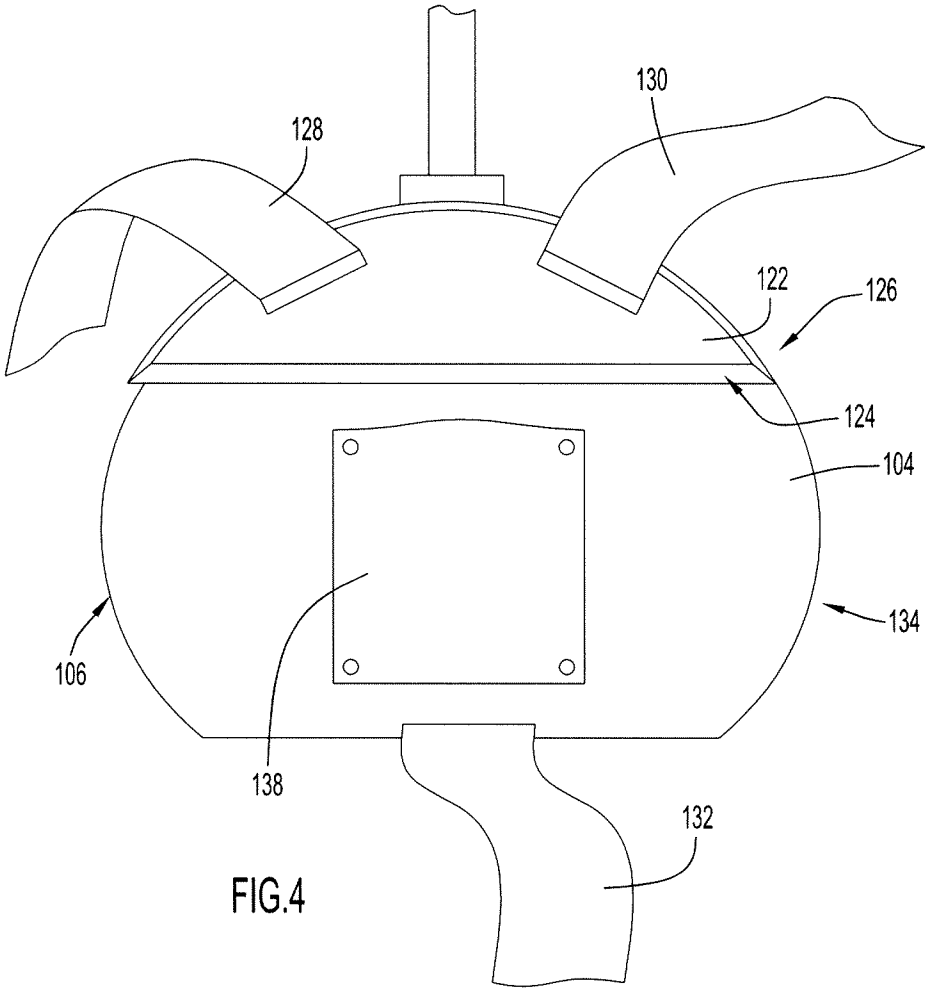
FIG. 4 illustrates a rear view of the housing and a portion of the support arm illustrated in FIG. 3.
Figure 5:
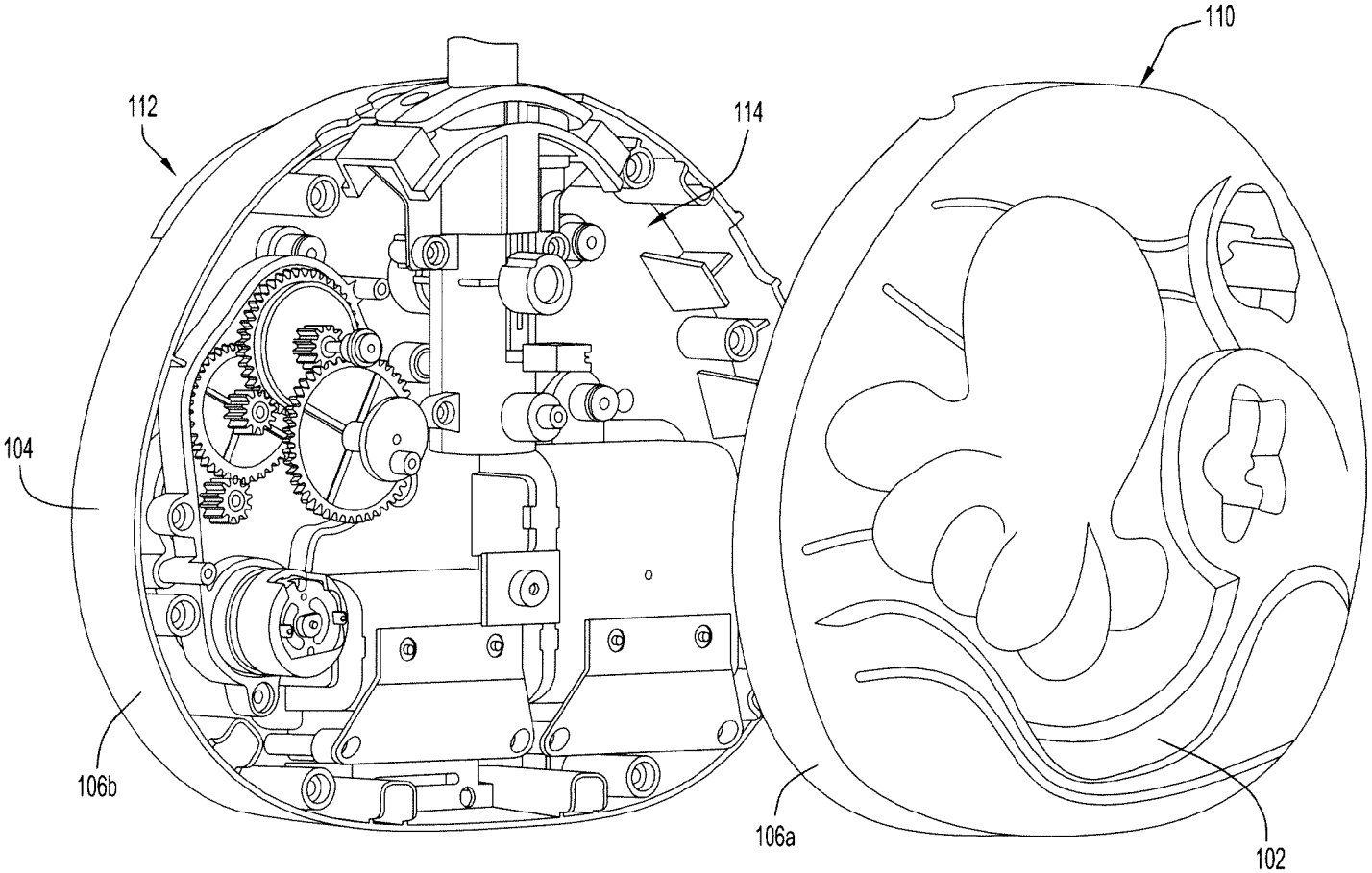
FIG. 5 illustrates a perspective view of some of the components of the housing and portions of the support arm.

Referring to FIGS. 3 and 4, the housing 100 includes a front face 102, an opposite rear face 104, and sidewall 106 extending therebetween. In one embodiment, housing 100 is configured as first and second portions or halves 110, 112, as shown in FIG. 5. The first housing portion 110 includes front face 102 and a first portion of sidewall 106*a*. The second housing portion 112 includes rear face 104 and a second portion of sidewall 106*b*. The first portion of sidewall 106*a* slides over and is secured to the second portion of sidewall 106*b*, thereby defining a cavity 114 between first and second faces 102, 104.

The front face 102 may include one or more actuators operably coupled to a control unit disposed within the cavity 114 and configured to control sensory output. As illustrated in FIG. 3, the front face 102 includes two actuators 116, 118. Each actuator 116, 118 may be coupled to a switch capable of sending a signal to the control unit, described in further detail below. For example, actuator 116 may be operable as a mode switch configured to control pivotal motion of the support arm 200 and/or to control musical output from an associated speaker. As shown, the front face 102 includes a perforated speaker grill 120 aligned with the speaker to optimize sound emission to the infant. Actuator 118 may be operable as a light switch to control an illumination pattern of the housing 100. Thus, the housing 100 may include one or more light sources (not shown) adapted to project light through translucent portions on the front face 102 and/or portion(s) of the sidewall 106. The light source may comprise, but is not limited to, light emitting diodes (LEDs) and/or grain of wheat bulbs (GOWs). By way of specific example, a light source may be aligned with and project through the support arm 200, which may have a tubular configuration with one or more translucent and/or transparent portions, or may be entirely translucent or transparent. Alternatively or in addition, light sources may be provided behind actuators 116, 118, and/or other portions of face 102, which include translucent and/or transparent portions. Actuators 116, 118 are illustrated as depressible actuators having stylized configurations of a fish and a starfish, respectively. Such configurations are exemplary only. Moreover, other types of actuators may be provided, such as sliding actuators, rotatable actuators, etc.

In addition to stylized actuators 116, 118, front face 102 may also include other stylized figures or patterns appealing to infants. For example, the embodiment illustrated in FIG. 3 includes a caricature of an octopus 121. The mobile 10A may include stylized patterns, caricatures and colors representing a specific theme, such as an underwater theme.

Figure 6:
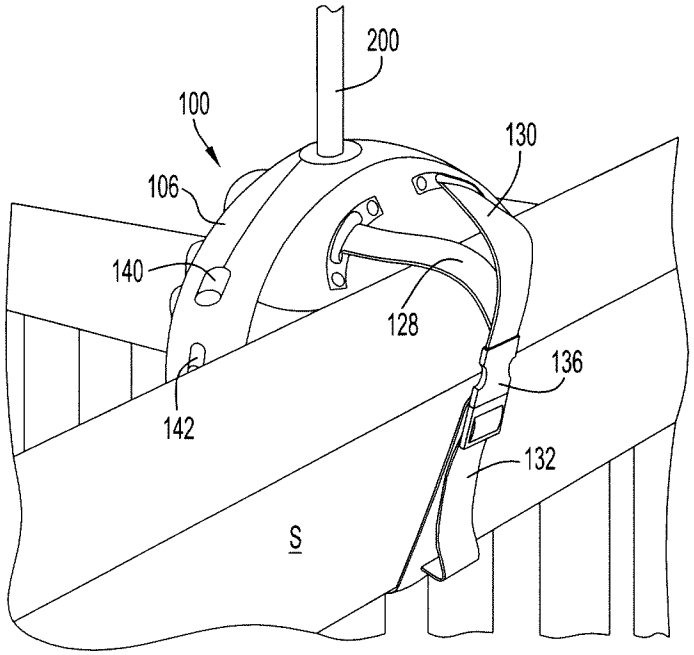
FIG. 6 illustrates a rear perspective view of the housing and a portion of the support arm illustrated in FIG. 2.

In addition or alternative to actuators 116, 118, one or more actuators operably coupled to the control unit may be provided on the sidewall 106. As illustrated in FIG. 6, two additional actuators 140, 142 are provided on sidewall 106, each of which is coupled to a switch capable of sending a signal to the control unit. For example, actuator 140 may be operable as a power switch that activates or deactivates a power source. Actuator 142 may be operable as a volume control switch configured to control the volume of audio output via the speaker 120. Accordingly, the housing 100 may include a speaker and associated audio components (not shown) configured for sound emission.

Any conventional control unit may be provided within the cavity 114 of the housing 100, such as the electronics assembly disclosed in U.S. Patent Publication No. 2006/0199468, the disclosure of which is incorporated herein by reference. The control unit may be operably coupled to each of the actuators, the speaker, the motor, light sources, and/or other sensory output mechanisms provided within the housing 100. The control unit may comprise, but is not limited to, microcontrollers, microprocessors, and integrated circuits. The control unit may be configured to not only recognize signals generated by the various switches, but also to generate and control the operational output of the sensory output generating devices (e.g. sound effects, verbal messages, music, motion, and light patterns).

Referring to FIGS. 4 and 6, the rear face 104 may include a securing mechanism for mounting the mobile 10A on an infant support structure S, for example a crib rail. As shown, the securing mechanism includes a mounting portion 122 having a ledge 124 extending outwardly from an upper portion 126 of the rear face 104. The ledge 124 is configured to abut the top rail of the crib, as best shown in FIG. 6. Upper straps 128, 130 are secured to and extend outwardly from the upper portion 126. A lower strap 132 is secured to and extends outwardly from a lower portion 134 of the rear face 104. The distal ends of straps 128, 130 are releaseably securable to the distal end of lower strap 132 via a buckle 136, such as a side release interlocking buckle. In this way, the straps 128, 130, 132 may encircle the crib rail, thereby securing the housing 100 thereto.

It should be understood that the specific configuration of the securing mechanism described and illustrated above is exemplary only. For example, an upper strap portion may be formed as a single strap as opposed to the two straps as discussed above. In alternative embodiments, a threaded engagement post may be provided, which extends outwardly from the rear face 104 and couples with an internally threaded gripping member so that the crib rails are clamped between the rear face 104 and the gripping member. Alternative securing mechanisms may include hooks and clips, a combination of hook and loop type materials, as well as other conventional fastening mechanisms.

The rear face 104 may further include a compartment 137 (shown in FIGS. 7 and 8) extending into the cavity 114, and a cover 138 adapted to extend over the compartment 137. The compartment 137 may be adapted to house a power source such as a battery or multiple batteries. The cover 138 may be secured to the rear face 104 using conventional fasteners such as screws. The cover 138 is preferably flush with the surface of the lower portion 134 when secured thereto.

Figure 7:
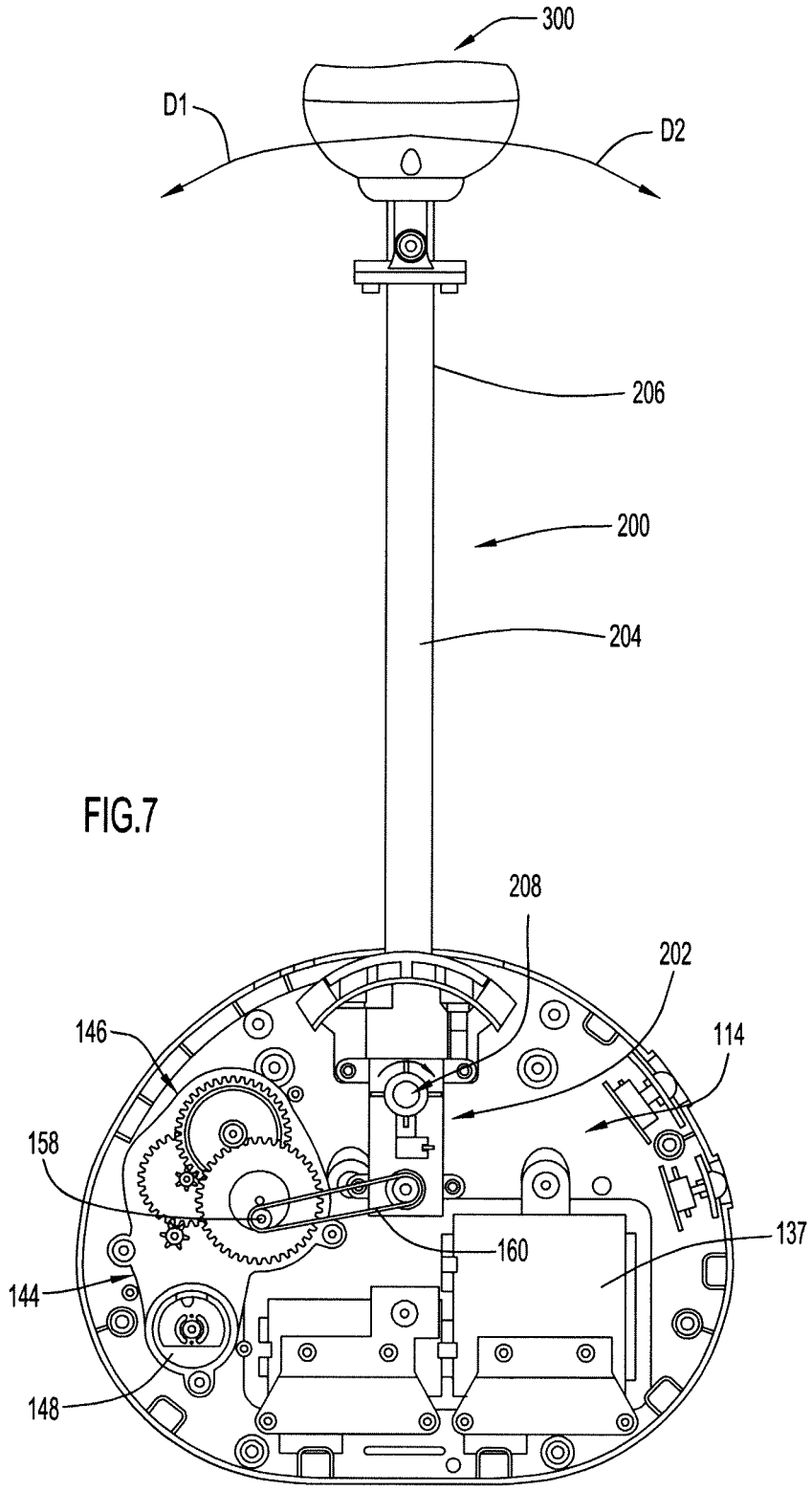
FIG. 7 illustrates a front view of the mobile illustrated in FIG. 2 showing an internal cavity of the housing and components therein.
Figure 8:
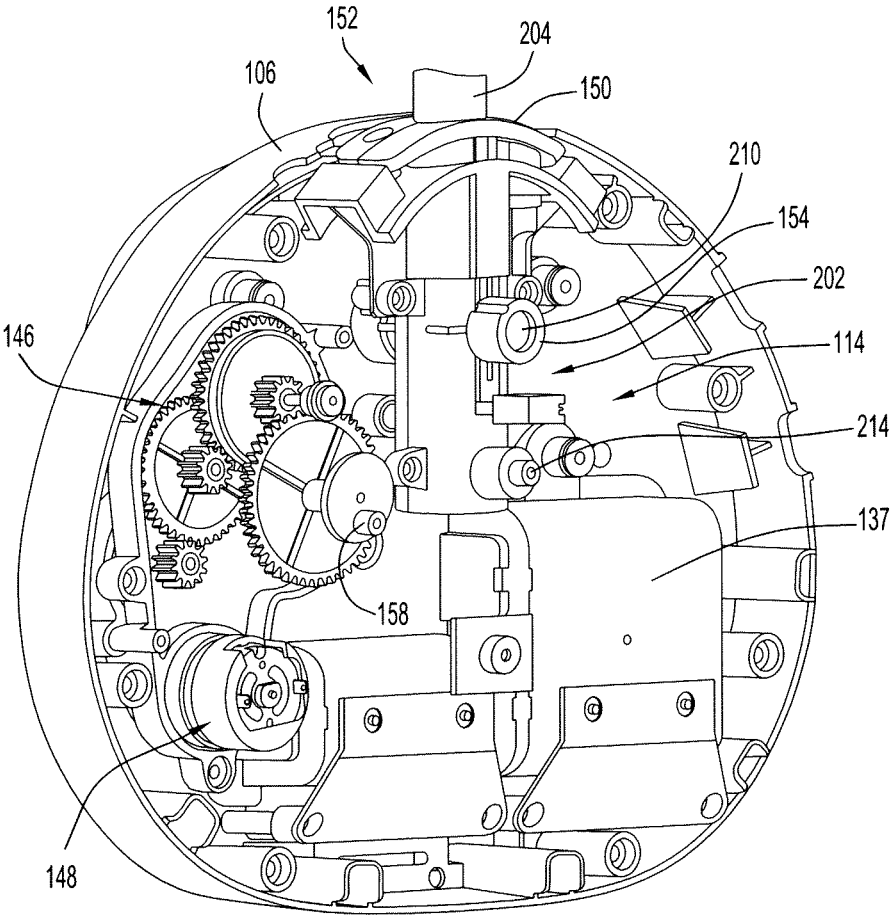
FIG. 8 illustrates a perspective view of the housing illustrated in FIG. 7 showing a first half of the housing separated from a second half of the housing.

Referring to FIGS. 7 and 8, the housing 100 further includes a drive mechanism 144 disposed within the cavity 114. The drive mechanism 144 includes a gear arrangement 146 driven by an associated motor 148. The motor 148 is coupled to and powered by a power source, such as batteries disposed within the compartment ent 137. Alternatively, the drive mechanism 144 may be powered by an associated AC adapter and power cord connected to a power source (e.g. an electrical outlet). The support arm 200 is coupled to the drive mechanism 144, so that actuation of the drive mechanism 144 causes pivotal motion of the support arm 200 relative to the housing 100 in the first and second directions D1, D2.

Figure 9:
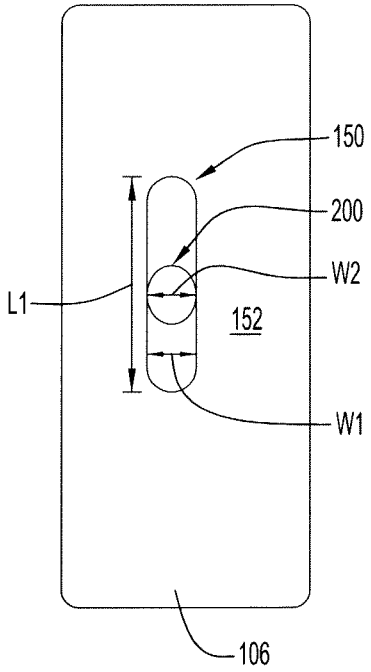
FIG. 9 illustrates a top view of the housing and a portion of the support arm.

Support arm 200 includes a first end portion 202 disposed within the cavity 114, a central portion 204 extending outwardly from a slot 150 (shown in FIG. 9) disposed in the sidewall 106, and an opposite second end portion 206 attached to the assembly 300 (described in detail below). As shown in FIG. 9, the slot 150 has a width W1 slightly larger than the width W2 of the portion of support arm 200 extending therethrough, and a length L1 greater than the width W2 of the portion of the support arm 200 extending therethrough. Preferably, the slot 150 is disposed at an apex 152 of sidewall 106.

Figure 10:
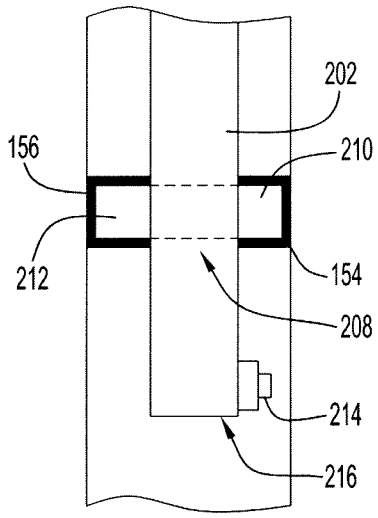
FIG. 10 illustrates a fragmentary sectional side view of some of the components of the housing.

The first end portion 202 of support arm 200 is connected to the housing 100 within the cavity 114 via a pivot shaft 208. The pivot shaft 208 extends through a corresponding opening (shown in phantom in FIG. 10) in the first end portion 202. As shown, opposite ends 210, 212 of the pivot shaft 208 extend outwardly from the support arm 200, and are received and secured within engagement members 154, 156 extending from the interior surfaces of front and rear faces 102, 104, respectively. The pivot shaft 208 defines a pivot point, whereby the support arm 200 is pivotally moveable about a longitudinal axis of the pivot shaft 208 in the first and second directions D1, D2. The first end portion 202 of the support arm 200 also preferably includes a pin 214 extending outwardly therefrom and intermediate the pivot shaft 208 and a distal end 216 of the support arm 200.

The gear arrangement 146 is configured for rotating a pin 158 about a circumferential path. Pin 158 is coupled to pin 214 via a linkage 160 (shown in FIG. 7), thereby coupling the drive mechanism 144 to the support arm 200. Actuation of the gear arrangement 146 causes the pin 158 to rotate about its circumferential path, which in turn causes the linkage 160 to push and pull the pin 214 of the first end portion 202. The support arm 200 is pivoted in the first direction D1 as pin 214 is pushed by the linkage 160, and then pivoted in the second direction D2 as pin 214 is pulled by the linkage 160. Thus, the support arm 200 oscillates back and forth in the first and second directions D1, D2 as pin 158 traverses its circumferential path.

Referring to FIGS. 2 and 7, the central portion 204 of the support arm 200 may have an arcuate configuration, so that the second end portion 206 lies on a plane spaced from the plane on which the front face 102 lies. In this way, the assembly 300 may be positioned over an infant lying in the support structure S when the housing 100 is secured to the support structure S (e.g. the crib rail). Alternatively, the support arm 200 may be substantially linear, extending outwardly from the housing 100 at an angle relative to the plane on which the front face 102 lies. Alternatively, the support arm 200 may include two or more linear portions angularly disposed relative to each other. In any event, the second end portion 206 and thus assembly 300 are preferably disposed outwardly from the plane on which the front face 102 lies.

Figure 11:
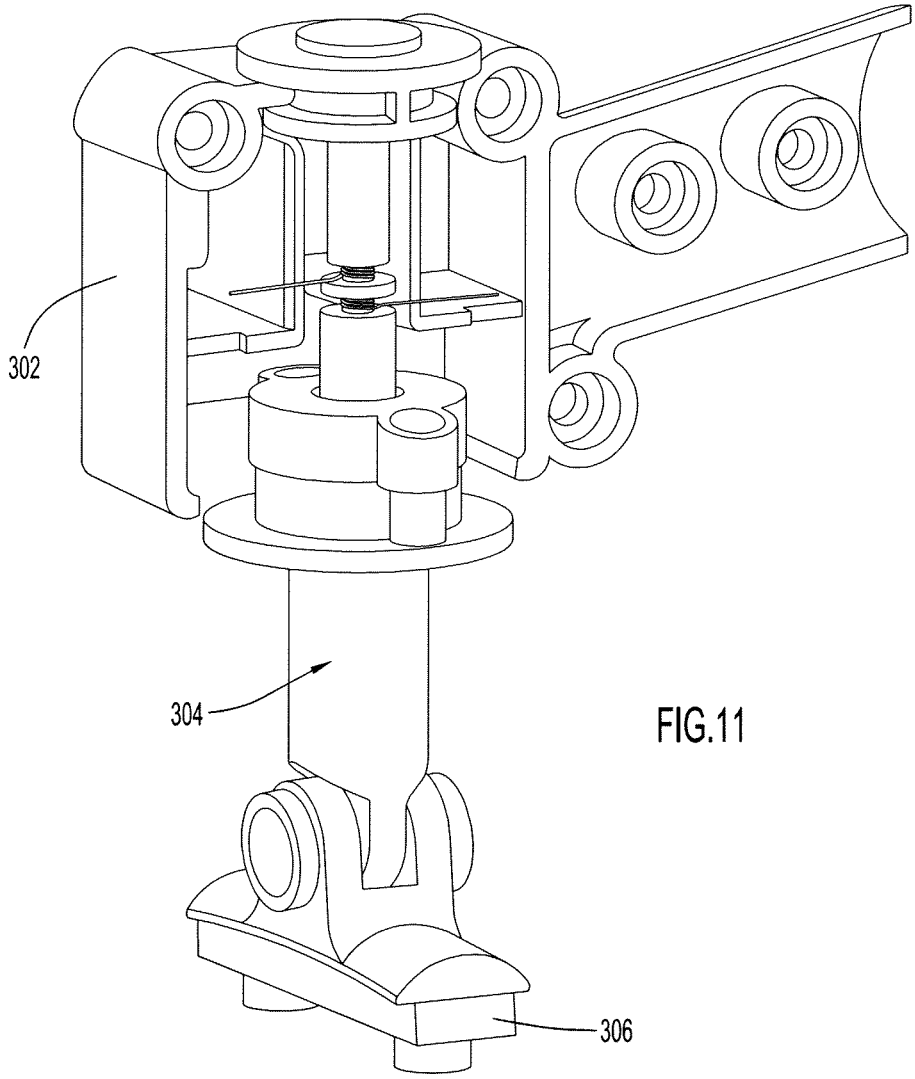
FIG. 11 illustrates a perspective view of some of the components of the assembly including portions of a hub, portions of a motion portion, and portions of a hanging portion
Figure 12:
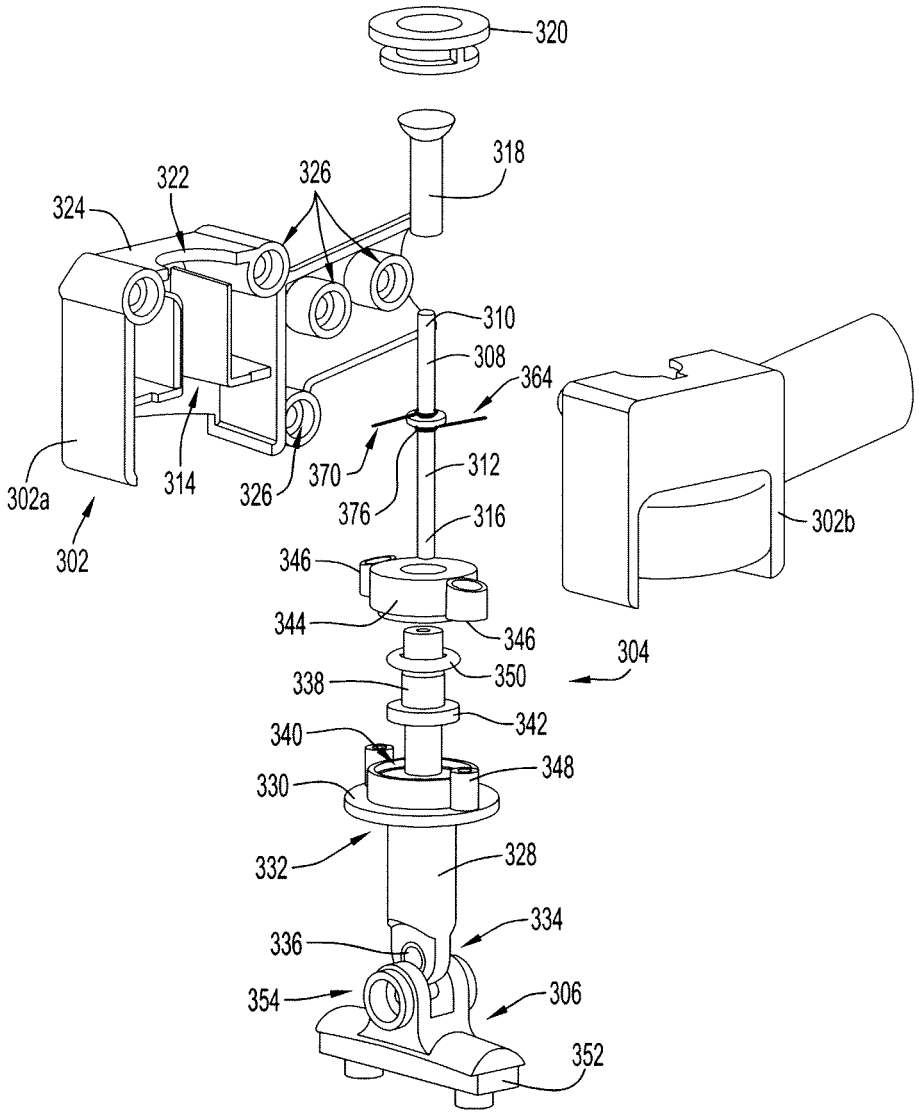
FIG. 12 illustrates an assembly view of some of the components of the hub, motion portion, and hanging portion.

Referring to FIGS. 7 and 11, assembly 300 includes a hub 302, a motion portion 304, and a hanging portion 306. Referring to FIG. 12, the motion portion 304 includes a drive shaft 308 having a first end 310 rotatably coupled to the hub 302, a central portion 312 extending downwardly through a chamber 314 provided within the hub 302, and an opposite second end 316. The first end 310 may be coupled to the hub 302 via a flanged sleeve 318, which is rotatably seated within a ring member 320. Thus, the coupling between the flanged sleeve 318 and the ring member 320 allow for rotational movement of the drive shaft 308 about its longitudinal axis and relative to the hub 302. In addition, the coupling between the flanged sleeve 318 and ring member 320 allow for pivotal movement of the drive shaft 308 relative to the hub 302 as the assembly 300 rocks back and forth in the first and second directions D1, D2.

The ring member 320 is secured within an opening 322 disposed within a top surface 324 of the hub 302, so that the central portion 312 of the drive shaft 308 extends downwardly through the chamber 314, as shown in FIG. 11.

Referring again to FIG. 12, the hub 302 may include first and second portions or halves 302*a*, 302*b*, which may be secured together using conventional fasteners such as screws or pins. Accordingly, receiving members 326 may be provided in first portion 302*a*, and internally threaded posts (not shown) may be provided in the second portion 302*b*. Fasteners may extend through the receiving members 326 and into the aligned internally threaded posts, thereby securing the first and second portions 302*a*, 302*b* together.

The second end 316 of the drive shaft 308 is coupled to the hanging portion 306 via a coupling member 328. As shown, the coupling member 328 includes a shelf 330 extending outwardly from a first end 332 thereof, and a second opposite end 334 having an opening 336. The second end 316 of the drive shaft 308 is received and secured within a sleeve 338, which in turn is received within a bore 340 extending into the coupling member 328 and axially aligned with the drive shaft 308. The sleeve 338 includes a central flange 342 that abuts the shelf 330 of the coupling member 328. A collar 344 fits over the central flange 342 and is secured to the shelf 330. The collar 344 may include engagement members 346. Internally threaded posts 348 may be provided on the shelf 330, which are received in engagement members 346 and secured thereto via threaded fasteners (not shown). A resilient wear ring 350 may also be provided intermediate the central flange 342 and the collar 344.

The second end 334 of the coupling member 328 is preferably pivotally connected to the hanging portion 306. The hanging portion 306 includes a support bar 352 having an attachment mechanism securable to the second end 334. As shown, the support bar 352 includes a central bracket 354 that is coupled to the second end 334 via a corresponding shaft (not shown), which passes through the opening 336 in the second end 334 of the coupling member 328, and permits the support bar 352 to pivot relative to the coupling member 328.

Referring to FIG. 2, one or more entertainment elements 358 may be coupled to the support bar 352. The entertainment elements 358 may include but are not limited to plush figures, rigid figures, geometric shapes, etc. Moreover, the entertainment elements 358 may include stylized patterns, caricatures and colors representing a specific theme, such as an underwater theme.

The entertainment elements 358 are coupled to the support bar 352 via connectors 360. The connectors 360 may be flexible, comprising for example fabric string or elastic cord. Alternatively, the connectors may be rigid. Alternatively, the entertainment elements 358 may be directly connected to the support bar 352. In addition, one or more secondary support bars may be provided. As shown, a second support bar 362 is coupled to support bar 352 via a connector 360, and supports additional entertainment elements 358.

The motion portion 304 includes at least a first resilient component coupled to the hanging portion 306 that effectuates rotational motion of the hanging portion 306 about an axis A1 in a third direction D3 when the support arm 200 moves in the first direction D1 (see FIGS. 1 and 7). Preferably, the motion portion 304 also includes a second resilient component coupled to the hanging portion 306, which effectuates rotational motion of the hanging portion 306 about the axis A1 in the third direction D3 when the support arm 200 moves in the second direction D2. The resilient components drive the hanging portion 306 in the third direction D3 when the support arm 200 rocks back and forth in the first and second directions D1, D2.

Figure 13C:
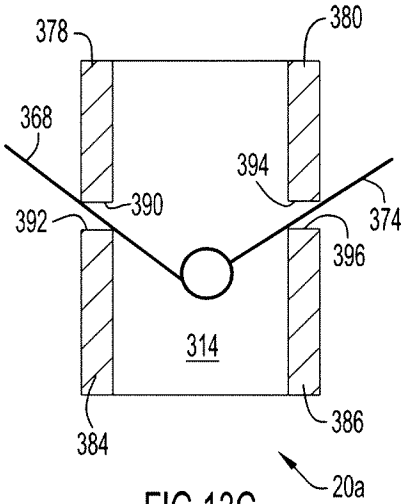
FIG. 13C illustrates a sectional top view of some of the components of the hub and motion portion in a third orientation.
Figure 13B:
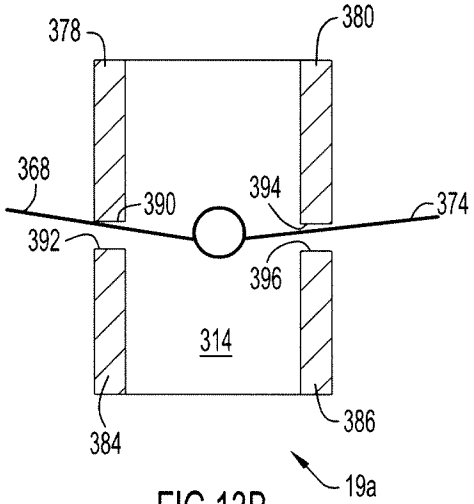
FIG. 13B illustrates a sectional top view of some of the components of the hub and motion portion in a second orientation.
Figure 13A:
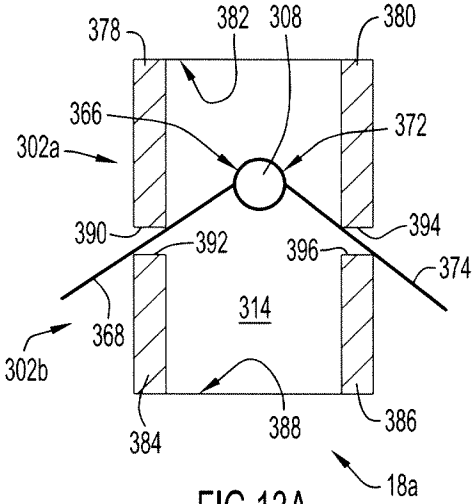
FIG. 13A illustrates a sectional top view of some of the components of the hub and motion portion in a first orientation.

Referring to FIGS. 12 and 13A, the first resilient component may be configured as a first spring 364 having a central coil 366 wound around the drive shaft 308 and an end portion 368 extending outwardly from the drive shaft 308 and into the chamber 314 of the hub 302. The second resilient component may be configured as a second spring 370 having a central coil 372 would around the drive shaft 308 and an end portion 374 extending outwardly from the drive shaft 308 and into the chamber 314. Preferably, the end portion 374 of the second spring 370 extends outwardly from the hanging portion 306 in a direction substantially opposite to the direction in which the end portion 368 of the first spring 364 extends when the support arm 200 is intermediate the first and second positions 18*a*, 20*a*, as shown in FIG. 13C. A washer 376 may be provided around the drive shaft 308 and intermediate the central coil 366 of the first spring 364 and the central coil 372 of the second spring 370.

The chamber 314 may be defined by first and second spaced walls 378, 380 extending outwardly from an inner surface 382 of the first half 302*a* of the hub 302, and first and second spaced walls 384, 386 extending outwardly from an inner surface 388 of the second half 302*b* of the hub 302. As shown in FIGS. 13A-13C, the first walls 378, 384 are spaced from each other, and define first and second spaced apart engagement surfaces 390, 392, respectively. Likewise, the second walls 380, 386 are spaced from each other, and define third and fourth spaced apart engagement surfaces 394, 396, respectively. The end portion 368 of the first spring 364 extends between the first and second engagement surfaces 390, 392. The end portion 374 of the second spring 370 extends between the third and fourth engagement surfaces 394, 396.

Pivotal and rotational motion of the drive shaft 308 will be described with reference to FIGS. 13A-13C. As the support arm 200 pivots in the first direction D1 to the first position 18, the hanging portion 306 also pivots in the first direction D1 (see FIG. 13A) due to the pivotal connection of the shaft 308 to the hub 302, and due to the weight of the hanging portion 306. Once the support arm reaches the first position 18, it then pivots in the second direction D2, past an apex of the pivotal arc traversed by the assembly 300 (see FIG. 13B), and to the second position 20 (see FIG. 13C).

The shaft 308 pivots back and forth relative to the hub 302 between a first position 18*a* (FIG. 13A), past a central position 19*a* (FIG. 13B), to a second position 20*a* (FIG. 13C). As the drive shaft 308 moves in the first direction D1 from the second position 20*a* toward the first position 18*a*, the end portion 368 of the first spring 364 engages the first engagement surface 390, for example when the drive shaft 308 reaches the central position 19*a*. As the drive shaft 308 continues to move in the first direction D1, the force applied against the end portion 368 by the first engagement surface 390 is transferred to the central coil 366. The central coil 366 is coiled around the drive shaft 308 such that the transferred force causes the central coil 366 to constrict and tighten around the drive shaft 308 as it moves in the first direction D1. Thus, the configuration of the first spring 364, and in particular the configuration of the central coil 366 of the first spring 364, is changed as the support arm 200 moves in the first direction D1.

The drive shaft 308 continues to move in first direction D1 after the central coil 366 has tightened around the drive shaft 306. Thus, the orientation and position of the central coil 366, and angle at which the end portion 368 extends relative to the first walls 378, 384, varies depending on the position of the central coil 366 along the path of motion between the first position 18*a* and the second position 20*a*. In addition, the distance between the central coil 366 and the first engagement surface 390 varies depending on its position along the path of motion between the first position 18*a* and the second position 20*a*.

As the drive shaft 308 moves along its path of motion between the first position 18*a* and the second position 20*a*, the end portion 368 pivots about the first engagement surface 390. The central coil 366, in turn, is caused to rotate about axis A1 as it is pivoted relative to the first engagement surface 390. The drive shaft 308 is thereby rotated about axis A1 in the third direction D3, given the central coil 366 is tightened around the drive shaft 308. Thus, the change in configuration of the first spring 364 causes the hanging portion 306 to move in the third direction D3.

The end portion 368 is preferably permitted to slide against the first engagement surface 390 as the central coil 366 moves along the path of motion, given the distance between the central coil 366 and the first engagement surface 390 varies depending on its position along the path of motion. In this way, the path of motion between the first position 18*a* and the second position 20*a* of the central coil 366 remains substantially linear. At the same time, the central coil 366 and the drive shaft 308 are caused to rotate in the third direction D3 as they move in the first direction D1.

Once the support arm 200 reaches the first position 18, it then moves in the second direction D2, pivoting from the first position 18 back to the second position 20 (see FIG. 1). The central coil 366 and the drive shaft 308 likewise move in the second direction D2, pivoting from the first position 18*a* (FIG. 13A) to the second position 20*a* (FIG. 13C). As the drive shaft 308 moves in the second direction D2, the end portion 368 of the first spring 364 moves away from the first engagement surface 390 toward the second engagement surface 392. The end portion 368 then engages the second engagement surface 392. As the drive shaft 308 continues to move in the second direction D2, the force applied against the end portion 368 by the second engagement surface 392 is again transferred to the central coil 366. However, the transferred force causes the central coil 366 to loosen from the drive shaft 308 as it moves in the second direction D2.

As the drive shaft 308 moves along its path of motion from the first position 18*a* and the second position 20*a*, the end portion 368 pivots about the second engagement surface 392, and is permitted to slide against the second engagement surface 392. The central coil 366 is caused to rotate about axis A1 as it is pivoted relative to the second engagement surface 390. However, the central coil 366 slides around the drive shaft 308, and therefore does not rotate the drive shaft 308 when moving in the second direction D2 given it is not tightened around the drive shaft 308. Thus, the first spring 364 does not drive rotation of the hanging portion 306 when the support arm 200 moves in second direction D2.

The second spring 370 functions in a similar manner compared to the first spring 364. However, because the end portion 374 of the second spring 370 extends outwardly from the drive shaft 308 in a direction substantially opposite to the direction in which the end portion 368 of the first spring 364 extends, the change in configuration of the second spring 370 due to movement of the support arm 200 in the first and second directions D1, D2 is inverse to that of the first spring 364.

Specifically, as the drive shaft 308 moves in the first direction D1 from the second position 20*a* (FIG. 13C) toward the first position 18*a* (FIG. 13A), the end portion 374 of the second spring 370 engages the third engagement surface 394. As the drive shaft 308 continues to move in the first direction D1, the force applied against the end portion 374 by the third engagement surface 394 is transferred to the central coil 372.

The central coil 372 is coiled around the drive shaft 308 such that the transferred force causes the central coil 372 to loosen from around the drive shaft 308 as it moves in the first direction D1. Thus, the configuration of the second spring 370, and in particular the configuration of the central coil 372, is changed as the support arm 200 moves in the first direction D1.

The drive shaft 308 continues to move in first direction D1 after the central coil 372 has been loosened from around the drive shaft 308. The orientation and position of the central coil 372, and angle at which the end portion 374 extends relative to the second walls 380, 386, varies depending on the position of the central coil 372 along the path of motion between the first position 18*a* and the second position 20*a*. In addition, the distance between the central coil 372 and the third engagement surface 394 varies depending on its position along the path of motion between the first position 18*a* and the second position 20*a*.

As the drive shaft 308 moves along its path of motion from the second position 20*a* to the first position 18*a*, the end portion 374 pivots about the third engagement surface 394. The central coil 372, in turn, is caused to rotate about axis A1 as it is pivoted relative to the third engagement surface 394. However, the central coil 372, having been loosened from around the drive shaft 308, slides about the drive shaft 308. As such, the second spring 370 does not drive rotation of the hanging portion 306 when the support arm 200 moves in first direction D1.

The end portion 374 is preferably permitted to slide against the third engagement surface 394 as the central coil 372 moves along the path of motion, given the distance between the central coil 372 and the third engagement surface 394 varies depending on its position along the path of motion. In this way, the path of motion between the first position 18*a* and the second position 20*a* of the central coil 372 remains substantially linear.

Once the support arm 200 reaches the first position 18, it then moves in the second direction D2, pivoting from the first position 18 back to the second position 20 (see FIG. 1). The central coil 372 and the drive shaft 308 likewise move in the second direction D2, pivoting from the first position 18*a* to the second position 20*a*. As the drive shaft 308 moves in the second direction D2, the end portion 374 of the second spring 370 moves away from the third engagement surface 394 and toward the fourth engagement surface 396. The end portion 374 then engages the fourth engagement surface 396. As the drive shaft 308 continues to move in the second direction D2, the force applied against the end portion 374 by the fourth engagement surface 396 is transferred to the central coil 372. The central coil 372 is coiled around the drive shaft 308 such that the transferred force causes the central coil 372 to constrict and tighten around the drive shaft 306 as it moves in the second direction D2.

The hanging portion 306 continues to move in second direction D2 after the central coil 372 has tightened around the drive shaft 306. As the drive shaft 308 moves along its path of motion between the first position 18*a* and the second position 20*a*, the end portion 374 pivots about the fourth engagement surface 396. The central coil 372, in turn, is caused to rotate about axis A1 as it is pivoted relative to the fourth engagement surface 396. The drive shaft 308 is thereby rotated about axis A1 in the third direction D3, given the central coil 372 is tightened around the drive shaft 308. Thus, the change in configuration of the second spring 370 causes the hanging portion 306 to move in the third direction D3.

The inverse relationship of the resilient components relative to the drive shaft 308 provide rotational movement in the third direction when the support arm moves in either the first direction D1 or the second direction D2. Movement of the support arm 200 in the first direction D1 causes the first resilient component (e.g. spring 364) to change its configuration. Movement of the support arm 200 in the second direction D2 causes the second resilient component (e.g. spring 370) to change its configuration. This change in configuration of each of the first and second resilient components causes rotational movement of the hanging portion 306 in the third direction D3.

It should be understood however that assembly 300 need not include two resilient components. For example, a single resilient component may be provided, which drives rotation of the hanging portion 306 in the third direction D3 only when the support arm moves in the first direction D1 but not in the second direction D2 (or vice versa).

Figure 14:
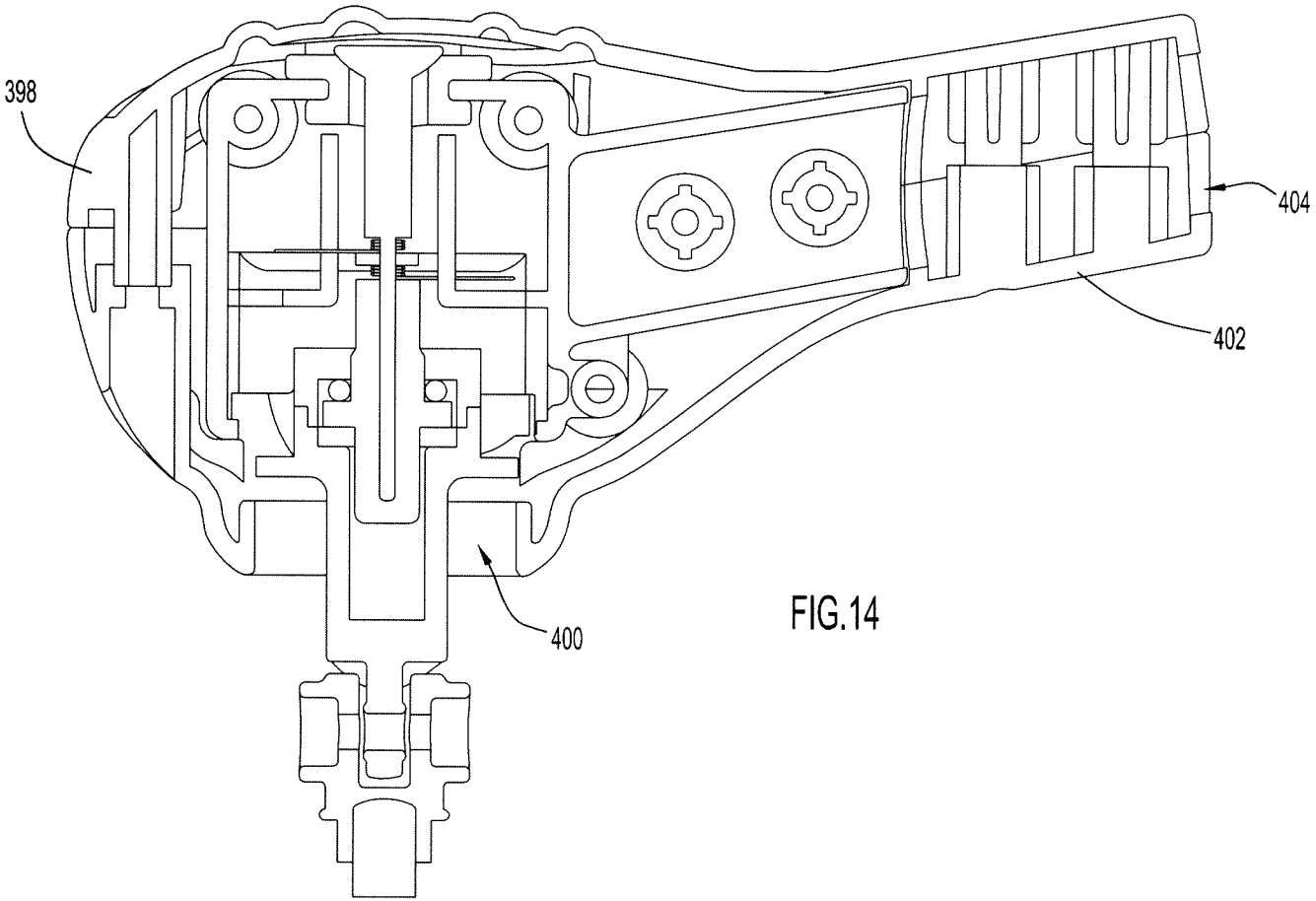
FIG. 14 illustrates a sectional side view of some of the components of the assembly.

Referring to FIG. 14, the assembly 300 may further include an outer shell 398 encasing the hub 302 and a portion of the motion portion 304. The outer shell 398 includes an opening 400 in an underside thereof through which the coupling member 328 of the motion portion 306 extends. The outer shell 398 may also include an arm 402 having a bore 404 in which the second end portion 206 of the support arm 200 is received and secured.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. Accordingly, it is appropriate that the appended claims be construed broadly and in a manner consistent with the scope of the disclosure as set forth in the following claims.

What is claimed is:

1. A mobile comprising:

a housing supported by an infant support structure, the housing including a drive mechanism;

a support arm extending from the housing, the support arm being connected to the drive mechanism and movable relative to the housing in a first direction and in a second direction, the second direction being opposite to the first direction; and an assembly supported from the support arm, the assembly including a hub, a motion portion, and a hanging portion, the motion portion having at least one resilient component coupled to the hanging portion, the at least one resilient component driving the hanging portion in a third direction when the support arm moves in the first direction, the third direction being different than the first direction and the second direction.

2. The mobile of claim 1, wherein the at least one resilient component is configured not to drive the hanging portion when the support arm moves in the second direction.

3. The mobile of claim 1, wherein the at least one resilient component includes a first resilient component and a second resilient component, each of the resilient components is coupled to the hanging portion, the first resilient component driving the hanging portion in the third direction when the support arm moves in the first direction, the second resilient component driving the hanging portion in the third direction when the support arm moves in the second direction.

4. The mobile of claim 1, wherein the hub includes an engagement surface, the at least one resilient component includes a spring having an outwardly extending end, the outwardly extending end being engageable with the engagement surface.

5. The mobile of claim 4, wherein the engagement surface is a first engagement surface and the hub includes a second engagement surface, the first engagement surface being spaced apart from the second engagement surface, the spring end extending between the first engagement surface and the second engagement surface.

6. The mobile of claim 5, wherein the outwardly extending spring end engages the first engagement surface when the support arm moves in the first direction, and the spring end moves away from the first engagement surface when the support arm moves in the second direction.

7. The mobile of claim 1, wherein the at least one resilient component includes a first spring and a second spring, the first spring has an end portion extending away from the hanging portion and the second spring has an end portion extending away from the hanging portion, the second spring end portion extending in a direction substantially opposite to the direction in which the first spring end portion extends.

8. The mobile of claim 7, wherein movement of the support arm in the first direction causes one of the first spring and the second spring to change its configuration.

9. The mobile of claim 8, wherein the change in configuration of the one of the first spring and the second spring causes the hanging portion to move in the third direction.

10. The mobile of claim 7, wherein movement of the support arm in the first direction causes the first spring to change its configuration, movement of the support arm in the second direction causes the second spring to change its configuration, and the change in configuration of each of the first spring and the second spring causing rotation of the hanging portion in the third direction.

11. A mobile comprising:

a housing including a drive mechanism;

a support arm extending from the housing, the support arm being connected to the drive mechanism and movable relative to the housing in a first direction and in a second direction; and an assembly supported from the support arm, the assembly including a hub, a motion portion, and a hanging portion, the motion portion having a resilient mechanism coupled to the hanging portion, the resilient mechanism moving the hanging portion in a third direction when the support arm moves in the first direction and moving the hanging portion in the third direction when the support arm moves in the second direction, the third direction being different than the first direction and the second direction.

12. The mobile of claim 11, wherein the resilient mechanism includes a first spring member and a second spring member.

13. The mobile of claim 12, wherein the first spring member has an end extending from the hanging portion and the second spring member has an end extending from the hanging portion in a direction substantially opposite to the direction in which the first spring member end extends.

14. The mobile of claim 13, wherein the hub includes a first pair of engagement surfaces and a second pair of engagement surfaces, the end of the first spring member is engageable with the first pair of engagement surfaces, and the end of the second spring member is engageable with the second pair of engagement surfaces.

* * * * *

UNITED STATES PATENT AND TRADEMARK OFFICE

CERTIFICATE OF CORRECTION

PATENT NO. : 8,771,033 B2
APPLICATION NO. : 12/797921
DATED : July 8, 2014
INVENTOR(S) : Robert M. Goszewski et al.

It is certified that error appears in the above-identified patent and that said Letters Patent is hereby corrected as shown below:

In the Specification

Column 6, line 55, replace "disposed within the compartment ent 137" with "disposed within the compartment 137".

Signed and Sealed this
Twentieth Day of January, 2015

Michelle K. Lee

Michelle K. Lee
*Deputy Director of the United States Patent and Trademark Office*